US009127337B2

(12) United States Patent
Dunleavy et al.

(10) Patent No.: US 9,127,337 B2
(45) Date of Patent: Sep. 8, 2015

(54) MECHANICAL COMPONENT COMPRISING AN INSERT MADE OF COMPOSITE

(75) Inventors: Patrick Dunleavy, Palaiseau (FR); Jean-Michel Patrick Maurice Franchet, Paris (FR); Gilles Charles Casimir Klein, Mery sur Oise (FR); Richard Masson, Buc (FR)

(73) Assignees: SNECMA, Paris (FR); MESSIER-BUGATTI-DOWTY, Velizy-Villacoublay (FR)

( * ) Notice: Subject to any disclaimer, the term of this patent is extended or adjusted under 35 U.S.C. 154(b) by 1294 days.

(21) Appl. No.: 12/670,767

(22) PCT Filed: Jul. 10, 2008

(86) PCT No.: PCT/FR2008/001015

§ 371 (c)(1),
(2), (4) Date: Jul. 7, 2010

(87) PCT Pub. No.: WO2009/034264

PCT Pub. Date: Mar. 19, 2009

(65) Prior Publication Data

US 2011/0143089 A1 Jun. 16, 2011

(30) Foreign Application Priority Data

Jul. 26, 2007 (FR) ..... 07 05454

(51) Int. Cl.
*C22C 47/06* (2006.01)
*C22C 47/04* (2006.01)
(Continued)

(52) U.S. Cl.
CPC ..... *C22C 47/064* (2013.01); *C22C 47/04* (2013.01); *C22C 47/14* (2013.01); *C22C 49/04* (2013.01);
(Continued)

(58) Field of Classification Search
CPC ..... C22C 47/02; C22C 47/04; C22C 47/06; C22C 47/062; C22C 47/064; C22C 47/08; C22C 49/00; C22C 49/02; C22C 49/14; B22F 2999/00; B22F 3/15
USPC ..... 29/419.1, 429, 889.71; 228/193
See application file for complete search history.

(56) References Cited

U.S. PATENT DOCUMENTS 3,668,748 A * 6/1972 Divecha et al. ..... 29/419.1
3,669,364 A 6/1972 Sinizer et al.
(Continued)

FOREIGN PATENT DOCUMENTS

AU 31 714 71 2/1973
DE 100 05 250 8/2000
(Continued)

OTHER PUBLICATIONS

U.S. Appl. No. 12/670,786, filed Jan. 26, 2010, Dunleavy, et al.
(Continued)

*Primary Examiner* — Christopher M Koehler
(74) *Attorney, Agent, or Firm* — Oblon, McClelland, Maier & Neustadt, L.L.P.

(57) ABSTRACT

A method of manufacturing a mechanical component, and winding device to implementing the method. The component includes at least one insert of metal matrix composite, within which matrix ceramic fibers extend, the composite insert obtained from a plurality of coated filaments each including a ceramic fiber coated with a metal sheath. The method manufactures an insert preform by winding a bonded lap or bundle of coated filaments about a cylindrical component. At least some of the winding is performed in at least one rectilinear direction. The method further inserts the insert preform in a first container; performs hot isostatic compaction of the first container; and machines the first container to form a rectilinear insert.

12 Claims, 13 Drawing Sheets

(51) Int. Cl.
*C22C 47/14* (2006.01)
*C22C 49/04* (2006.01)

(52) U.S. Cl.
CPC ..... *B22F 2999/00* (2013.01); *Y10T 29/4998* (2015.01); *Y10T 428/24322* (2015.01); *Y10T 428/2935* (2015.01)

(56) References Cited

U.S. PATENT DOCUMENTS

| | | | | | |
|---|---|---|---|---|---|
| 3,795,042 | A | * | 3/1974 | Kreider et al. | 228/190 |
| 3,828,417 | A | * | 8/1974 | Divecha | 29/419.1 |
| 4,163,380 | A | * | 8/1979 | Masoner | 72/342.1 |
| 4,616,393 | A | * | 10/1986 | Beauregard et al. | 29/423 |
| 4,697,324 | A | * | 10/1987 | Grant et al. | 29/419.1 |
| 4,750,247 | A | * | 6/1988 | Anahara et al. | 29/33 E |
| 4,907,736 | A | * | 3/1990 | Doble | 228/190 |
| 4,919,594 | A | * | 4/1990 | Wright et al. | 416/230 |
| 5,222,296 | A | * | 6/1993 | Doorbar et al. | 29/889.21 |
| 5,305,520 | A | * | 4/1994 | Doorbar et al. | 29/889.21 |
| 5,427,304 | A | * | 6/1995 | Woods et al. | 228/190 |
| 6,569,360 | B2 | * | 5/2003 | Wu | 252/518.1 |
| 6,698,645 | B1 | * | 3/2004 | Buchberger et al. | 228/173.1 |
| 7,325,306 | B2 | * | 2/2008 | Twigg | 29/889.71 |
| 7,343,677 | B2 | * | 3/2008 | Twigg | 29/889.71 |
| 7,516,548 | B2 | * | 4/2009 | Twigg | 29/889.71 |
| 2005/0086789 | A1 | * | 4/2005 | Twigg | 29/505 |
| 2005/0166386 | A1 | * | 8/2005 | Twigg | 29/458 |
| 2006/0225252 | A1 | * | 10/2006 | Shindo et al. | 19/0.6 |
| 2006/0231586 | A1 | | 10/2006 | Blanchard et al. | |
| 2006/0269746 | A1 | | 11/2006 | Franchet et al. | |
| 2007/0051455 | A1 | | 3/2007 | Franchet et al. | |
| 2008/0210365 | A1 | | 9/2008 | Franchet et al. | |

FOREIGN PATENT DOCUMENTS

| | | |
|---|---|---|
| EP | 1 652 974 | 5/2006 |
| FR | 2 886 290 | 12/2006 |
| GB | 803 270 | 10/1958 |

OTHER PUBLICATIONS

U.S. Appl. No. 13/002,514, Jan. 4, 2011, Dunleavy, et al.
U.S. Appl. No. 13/002,580, Jan. 4, 2011, Dunleavy, et al.

* cited by examiner

MECHANICAL COMPONENT COMPRISING AN INSERT MADE OF COMPOSITE

BACKGROUND OF THE INVENTION

The present invention relates to a mechanical component comprising an insert made of composite of the type consisting of ceramic fibers in a metal matrix, and to a method of manufacturing this mechanical component and to a winding device designed to implement the method of manufacture. The invention applies to any kind of mechanical component the purpose of which is to transmit a tensile and/or compressive force chiefly in one direction.

In the field of aeronautical engineering in particular, there is a constant drive toward optimizing the strength of mechanical components for minimal mass and size. Hence, certain mechanical components may have an insert made of metal matrix composite, it being possible for such components to be of one piece. A composite such as this comprises a metal alloy matrix, for example made of titanium Ti alloy, within which fibers, for example ceramic silicon carbide SiC fibers, extend. Such fibers have a far higher tensile and compressive strength than titanium. It is therefore mainly the fibers that react the load, the metal alloy matrix acting as a binder connecting to the remainder of the component, as well as protecting and insulating the fibers, which have not to come into contact with one another. Furthermore, the ceramic fibers are resistant to erosion, but it is essential that they be reinforced with metal.

The composites as described hereinabove are known for their use, in the field of aeronautical engineering, in the manufacture of disks, shafts, the bodies of actuating cylinders, casings, struts or as reinforcements for one-piece components such as vanes.

DESCRIPTION OF THE PRIOR ART

One technique for manufacturing these components is described in document FR 2886290, which represent the technological background of the invention, in which document one of the essential steps in the manufacture consists in winding a bundle or lap of coated filaments around a circular component of revolution perpendicular to the axis of rotation thereof. The described components obtained in this way are of circular type and are mainly suited to the production of circular components such as shafts, the bodies of actuating cylinders, casings or disks.

However, some mechanical components require properties that differ from those exhibited by circular components. This is particularly the case of rods, which are essentially oblong in shape, and the purpose of which is to transmit a tensile and/or compressive load in one direction.

SUMMARY OF THE INVENTION

One particular subject of the invention is a method of manufacturing the mechanical component comprising at least one insert made of a composite of the type consisting of ceramic fibers in a metal matrix that is capable of transmitting tensile and/or compressive loads in one direction between its ends.

To this end, the invention relates to a method of manufacturing a mechanical component comprising at least one insert made of metal matrix composite, within which matrix ceramic fibers extend, the composite insert being obtained from a plurality of coated filaments each comprising a ceramic fiber coated with a metal sheath, the method involving manufacturing an insert preform with a step of winding a bonded lap or bundle of coated filaments about a cylindrical component. According to the invention, at least some of the winding is done in at least one rectilinear direction. The method further comprises:

- a step of inserting the insert preform in a first container;
- a step of hot isostatic compaction of the first container; and
- a step of machining the first container to form a rectilinear insert.

Once the insert has been manufactured, the method of manufacturing a mechanical component is followed by the following steps:

- a step of inserting the insert in a second container;
- a step of hot isostatic compaction of the second container; and
- a step of machining the second container to form a mechanical component.

The mechanical component thus obtained, for example a rod, is advantageously able to transmit tensile and/or compressive loads in one direction.

The invention also relates to a winding device specially designed to implement the method of manufacture according to the invention.

BRIEF DESCRIPTION OF THE DRAWINGS

Further advantages and features of the invention will become apparent from reading the detailed description which follows, with reference to the attached drawings in which.

DESCRIPTION OF THE PREFERRED EMBODIMENTS

The techniques of manufacturing a mechanical component comprising an insert made of composite, as described in document FR 2886290, can be used in the context of the present invention. Thus, the teaching of that document is to be considered to be incorporated into this application and, for example, and nonlimitingly, the structure of the coated filaments, the manufacture thereof, the manufacture of a bonded lap of coated filaments, the securing of this lap either to the metal support onto which it is wound or onto the lap of the layer below, the laser-welding of the filaments or their welding by contact between two electrodes, the hot isostatic compaction and machining.

Figure 1:
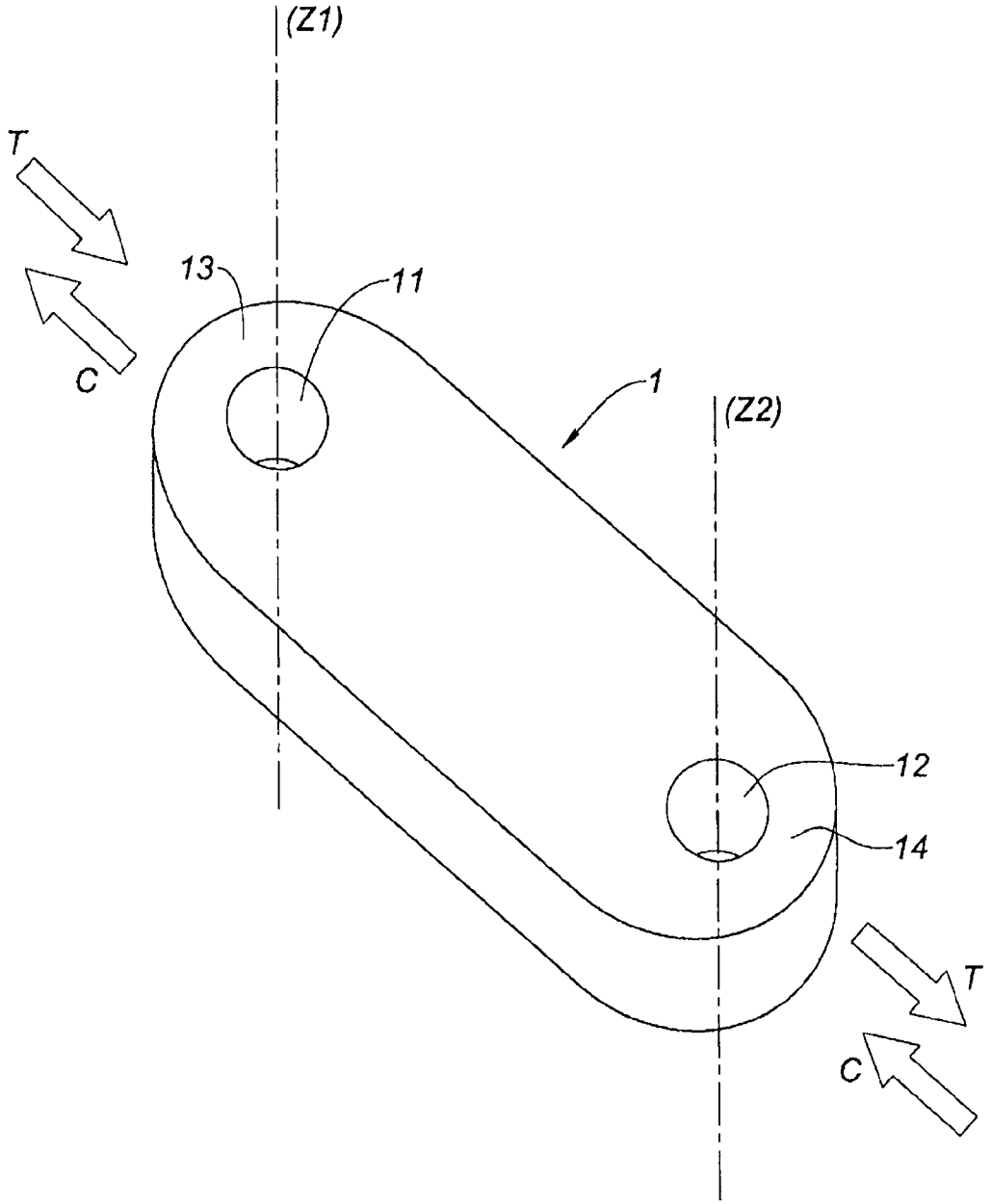
FIG. 1 is a perspective view of one example of a mechanical component according to the prior art.

FIG. 1 depicts one example of a mechanical component such as a rod 1 the shape of which is oblong overall, that is to say of elongate shape. It has two ends 13 and 14. The purpose of a rod 1 is to transmit a movement and/or tensile T and/or compressive C forces between two components articulated to the ends thereof about parallel axes Z1 and Z2. The rod 1, at each of its ends 13 and 14, has a cylindrical recess 11 or 12, the axes of which correspond to the parallel axes Z1 and Z2. This type of rod 1 may be used, for example, in the design of undercarriages or in that of turbomachines comprising thrust rods.

Figure 2:
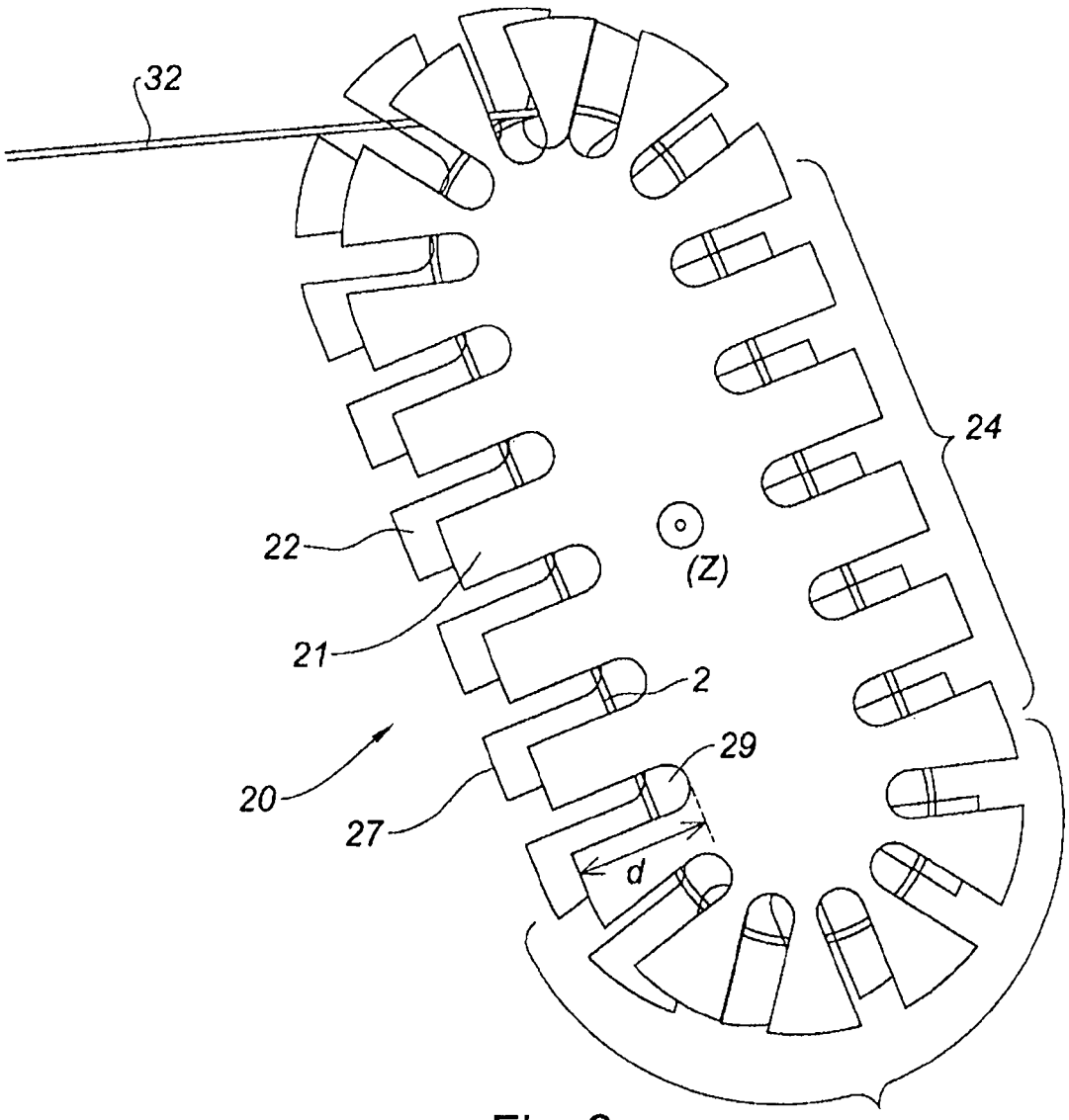
FIG. 2 is a perspective view of one example of a winding device according to a first embodiment of the invention.

FIG. 2 depicts an example of a winding device 20 according to a first embodiment of the invention. In this example, the winding device 20 is particularly well suited to create an insert 3 for a mechanical component 10 or 110 such as a rod. This winding device 20 comprises a cylindrical component 2 that is hollow and of oblong shape acting as a mandrel and two end plates 21 and 22 of oblong shape and substantially identical. The cylindrical component 2 has a geometry of revolution, that is to say a geometry that describes a closed structure, usually curved. The dimensions of the end plates 20 and 22 are greater than the dimensions of the cylindrical component 2 which means that the periphery 27 of each end plate 21 and 22 extends beyond the periphery of the cylindrical component 2. The cylindrical component 2 is sandwiched between the end plates 21 and 22. The filaments 32 are wound onto the cylindrical component 2 when the winding device 20 is rotated about the winding axis Z. The end plates 21 and 22 axially retain the coated filaments 32 and wind them.

The winding device 20 belongs to an assembly that forms a winding system. The winding system further comprises means for rotating the winding device 20 and means for supplying a bonded lap or bundle of coated filaments 32.

The cylindrical component 2 comprises two rectilinear winding portions 24. These rectilinear winding portions 24 are directed perpendicular to the winding axis Z. Thus, at least some of the winding of the filaments 32 about the cylindrical component 2 is done in a rectilinear direction. The winding of the coated filaments 32 is performed perpendicular to the winding axis Z, or in other words, the coated filaments 32 are directed substantially perpendicular to the winding axis Z.

In the example depicted in FIG. 2, these rectilinear winding portions 24 are parallel and fitted in between two circular portions 25. It is possible to vary the dimensions of the cylindrical component 2, particularly its thickness in the axial direction Z, the length of the rectilinear winding portions 24 and the radius of curvature of the circular parts 25, according to the dimensions of the desired insert 3. The circular parts 25 may also have different radii. Thus, the rectilinear winding portions 24 may be non-parallel.

Winding around the cylindrical component 2 comprising rectilinear winding portions 24 makes it possible, in a short space of time, to generate an insert 3 preform 33 having at least one rectilinear generatrix consisting of a great many parallel and uni-directional coated filaments 32.

The insert 3 preform 33, once wound, can be removed from the winding device 20 by detaching the end plates 21 and 22 from one another. The shape of the insert 3 preform 33 thus formed needs to be set so as to prevent the filaments 32 from losing their orientation. There are various techniques that can be employed to achieve this.

Figure 3:
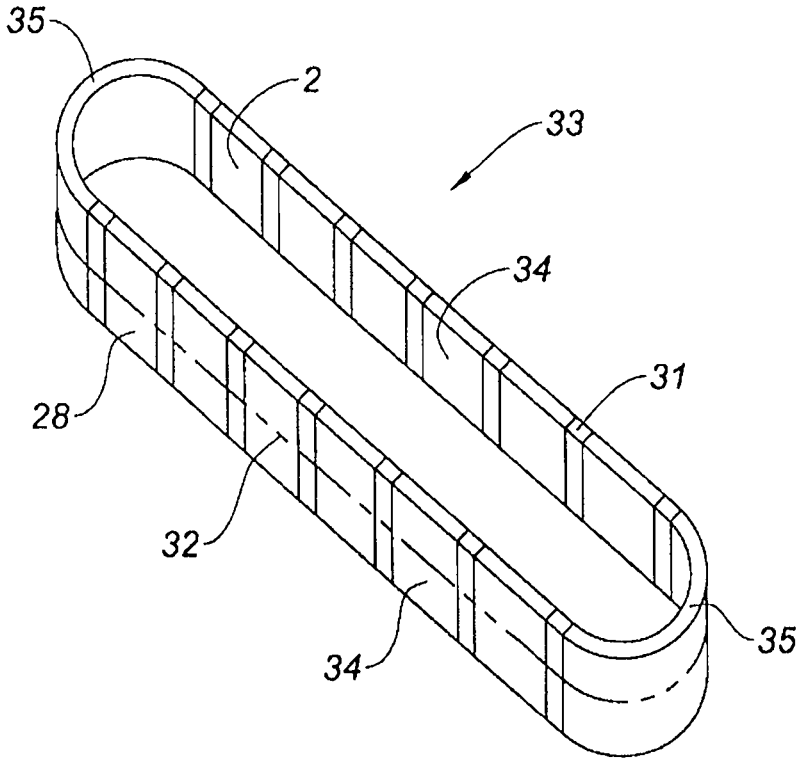
FIG. 3 is a perspective view of one example of an insert preform obtained according to the method of manufacture of the invention.

One first technique for maintaining the shape of the insert 3 preform 33 is to provide, at the start of winding, a step of winding a first metal foil that secures the internal part of the insert 3 preform 33 and to provide, at the end of winding, a step of winding a second metal foil 28 that secures the external part of the insert 3 preform 33. In this example, the first metal foil constitutes the cylindrical component 2. The coated filaments 32 therefore find themselves between the foils 2 and 28 as depicted in FIG. 3.

Moreover, as illustrated in FIG. 2, each end plate 21 and 22 has slots 23 on its periphery 27. Each slot 23 of the end plate 21 is positioned facing a slot 23 of the end plate 22, thus forming a pair of slots 23. The fitting of metal bands 31 is made easier by the dimensions of the slots 23 extending toward the inside of the end plates 21 and 22 over a depth d. The depth d of the slots 23 has to be such that it is possible to access the hollow inside 29 of the cylindrical component 2, which is positioned around a hub of the winding device 20, not visible in FIG. 2, comprising an alternation of slots and of teeth, the slots of the hub being in register with the slots 23 of the end plates 21 and 22. The depth d extends beyond the winding surface of the cylindrical component 2.

Each pair of slots 23 is intended to allow the attachment of a metal band 31. The metal bands 31 are made of a metallic material identical to that of the containers 4 and 104, described in conjunction with FIGS. 4 and 6, and of the cylindrical component 2. The metal bands 31 are fixed around the insert 3 preform 33 by a contact welding process. The metal bands 31 are positioned at regular intervals along the wound insert 3 preform 33.

Once the insert 3 preform 33 has been wound and the metal bands 31 have been fitted, this preform can be removed from the winding device 20 by detaching the end plates 21 and 22 from one another. An example of an insert 3 preform 33 thus obtained is depicted in FIG. 3. This consists of a cylindrical component of oblong shape comprising two rectilinear and parallel portions 34 fitted in between two circular portions 35.

A second technique for keeping the insert 3 preform 33 in shape, that does not involve the use of bands 31, is to provide a cylindrical component 2 forming an oblong mandrel comprising at least one radial rim, for example with an L-shaped or U-shaped cross section, onto which the filaments 32 are wound. When a bonded lap of coated filaments 32 is used, it is possible to secure it to the cylindrical component 2 onto which it is wound and to the lap of the layer below using a method of contact welding between two electrodes and by passing a medium frequency current. The filaments 32 are thus welded together as winding progresses which means that when the insert 3 preform 33 is removed from the winding device 20, it forms a component as one with the cylindrical component 2.

Figure 4:
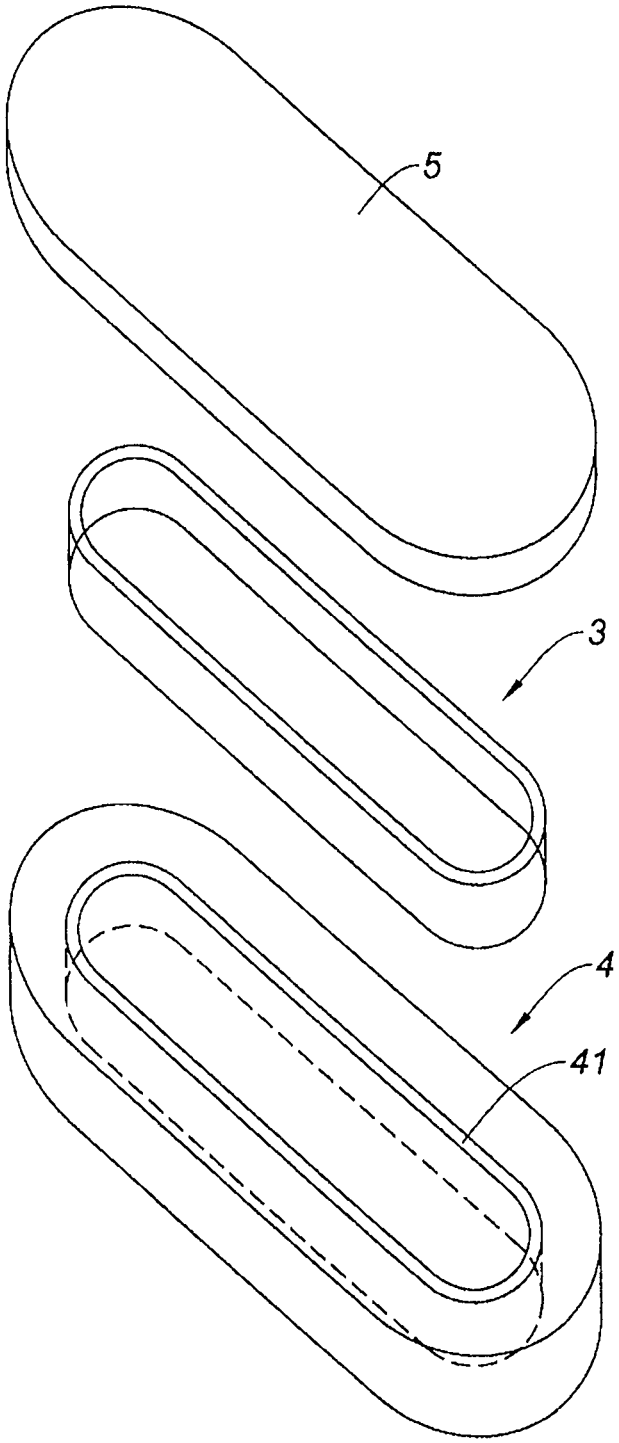
FIG. 4 is one example of an insert preform, of a first container intended to accommodate the insert preform and of a metal lid intended to seal said container and the insert preform.
Figure 5:
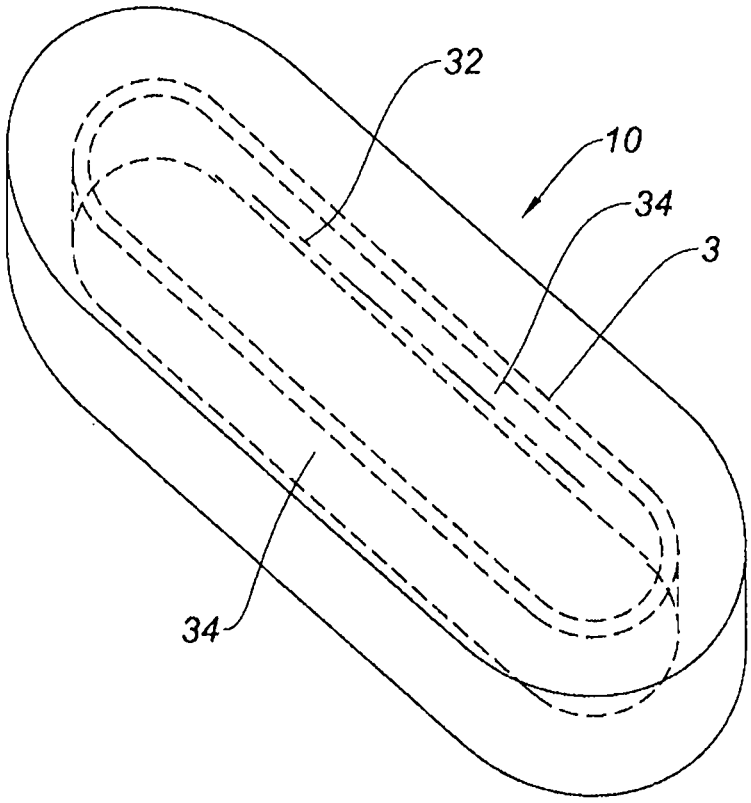
FIG. 5 is a perspective view of one example of an intermediate component obtained during one step of the method of manufacture according to a first embodiment of the invention.

The insert 3 preform 33 is then inserted in a first container 4, as depicted in FIG. 4. The container 4 for this purpose comprises a groove 41 of a shape that complements the insert 3 preform 33 and into which the insert 3 preform 33 is housed. A lid 5 is attached to the container 4 by electron welding, is evacuated, then compacted using a hot isostatic compaction process. The component thus obtained, depicted in FIG. 5, contains the insert 3 preform 33. In the insert 3 preform 33 that describes a revolution, the parts that make the most effective contribution toward transmitting one-way tensile and/or compressive forces are the rectilinear portions 34 of coated filaments 32. The hot isostatic compaction process is followed by a machining step aimed at extracting at least one rectilinear portion 34 forming an insert 3.

Figure 6:
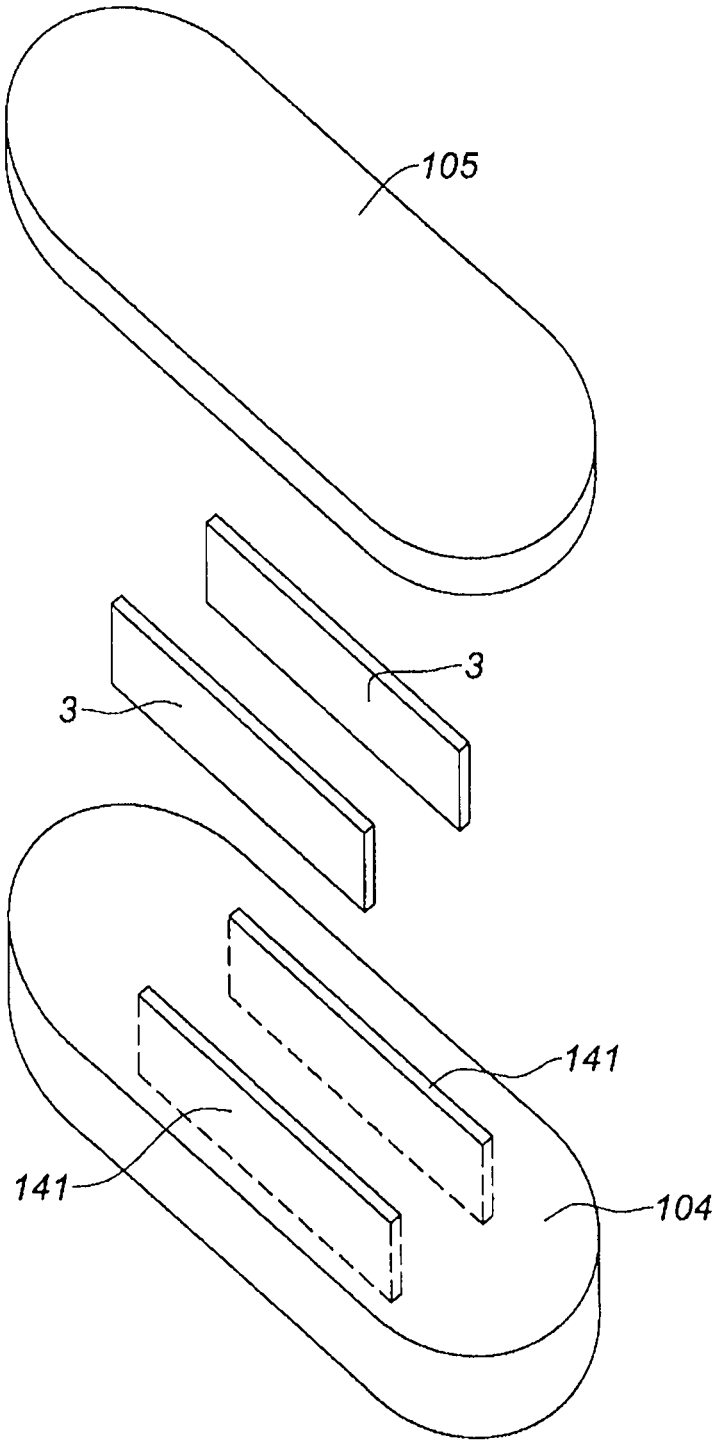
FIG. 6 is one example of an insert, of a second container intended to accommodate the insert preform and of a metal lid intended to seal said container and the insert.

As depicted in FIG. 6, the inserts 3 obtained after machining are then inserted in a second container 104. The second container 104 for this purpose has grooves 141 of a shape that complements the inserts 3 and in which the inserts 3 become housed. A lid 105 is attached to the container 104 by electron welding, is evacuated, then compacted using a hot isostatic compaction process. In FIG. 6, the inserts 3 are arranged parallel in the second container 104. It is equally possible to arrange them non-parallel, depending on the shape of the desired finished mechanical component. It is also possible to insert just one insert 3 in a container 104, depending on the dimensions of the desired finished mechanical component 10.

Figure 7:
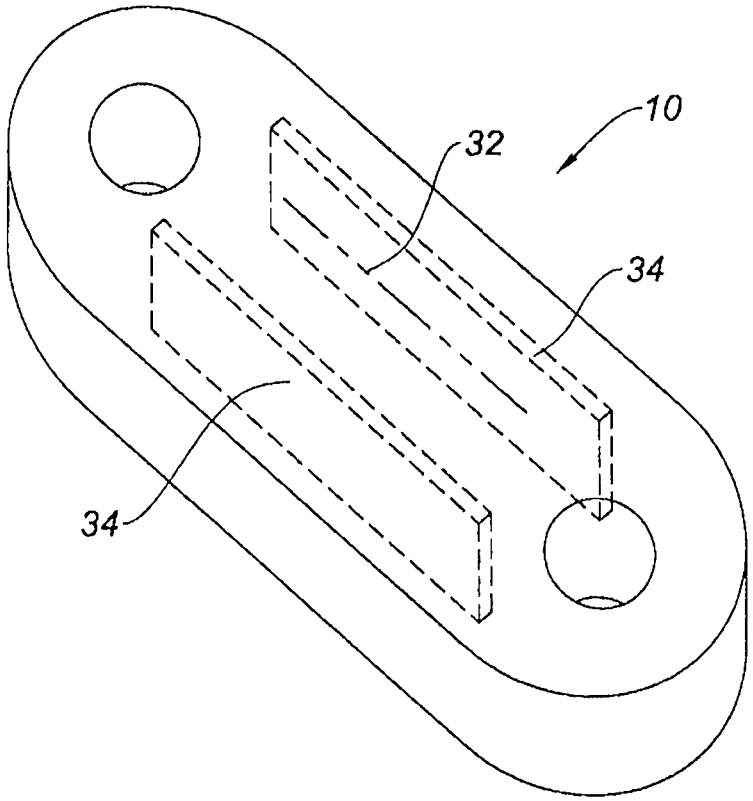
FIG. 7 is a perspective view of one example of a mechanical component obtained according to the method of manufacture of the invention.

The whole is then machined to obtain the finished mechanical component 10: a rod 10, depicted in FIG. 7. The rod 10, identical in shape to the rod 1 in FIG. 1, further comprises a plurality of inserts 3 made of composite, the filaments 32 of which are directed in a rectilinear direction. This rectilinear direction is perpendicular to the axes Z1 and Z2. This rod 10 is advantageously able to transmit one-way tensile and/or compressive forces. All the filaments of an insert 3 are directed in one and the same rectilinear direction.

The invention applies to any type of mechanical component the function of which is to transmit a tensile and/or compressive force mainly in one direction and is therefore not restricted solely to rods, which are just one application example.

Figure 8:
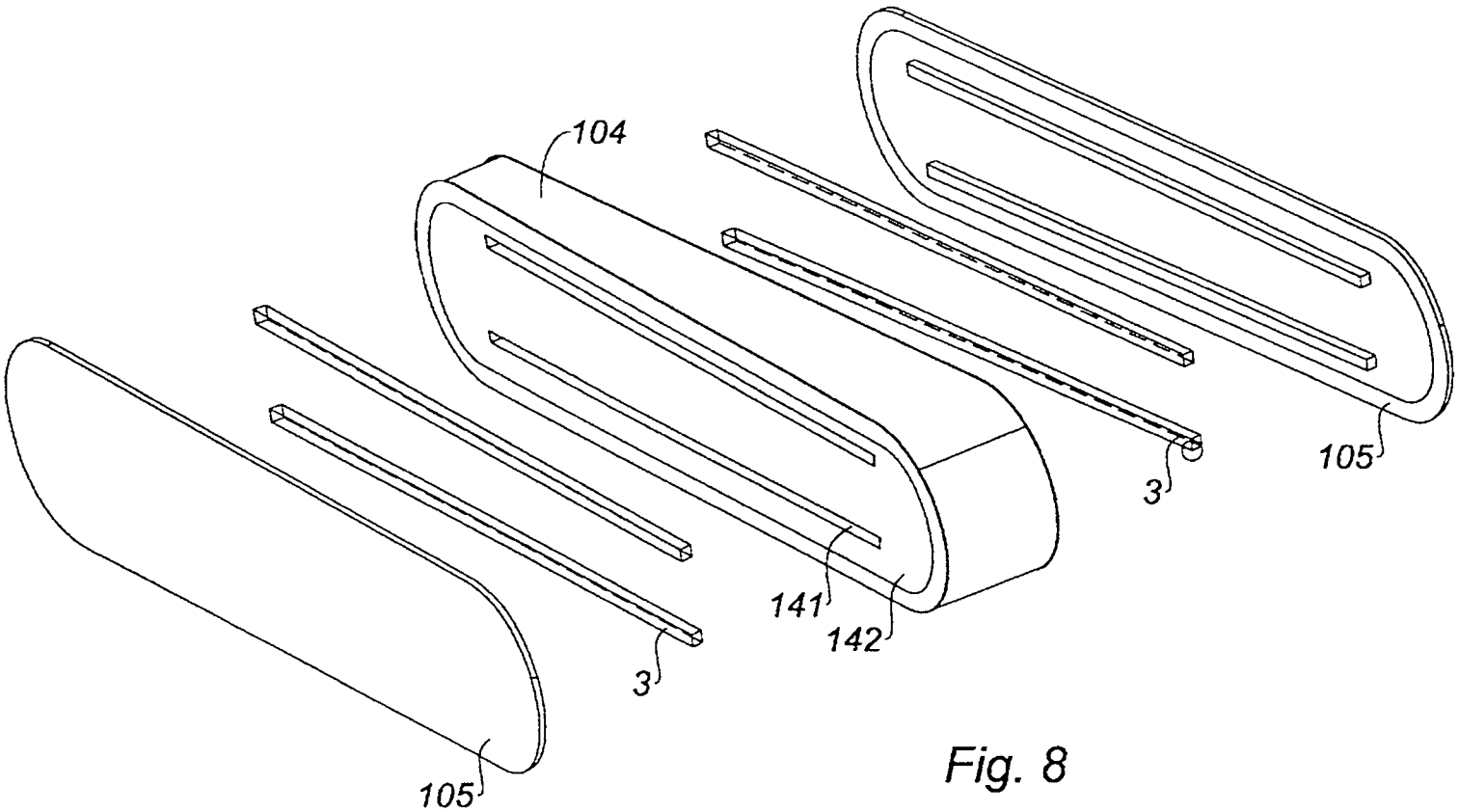
FIG. 8 is an alternative form of the method of manufacture of the invention.
Figure 9:
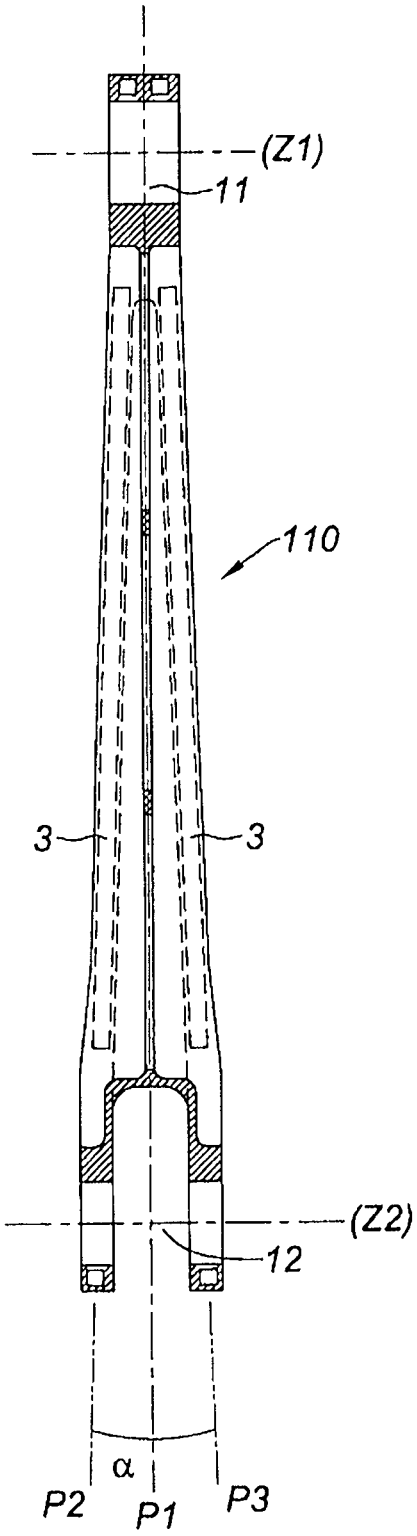
FIG. 9 is a cross section through one example of a mechanical component obtained according to the alternative form of the method of manufacture of the invention.
Figure 10:
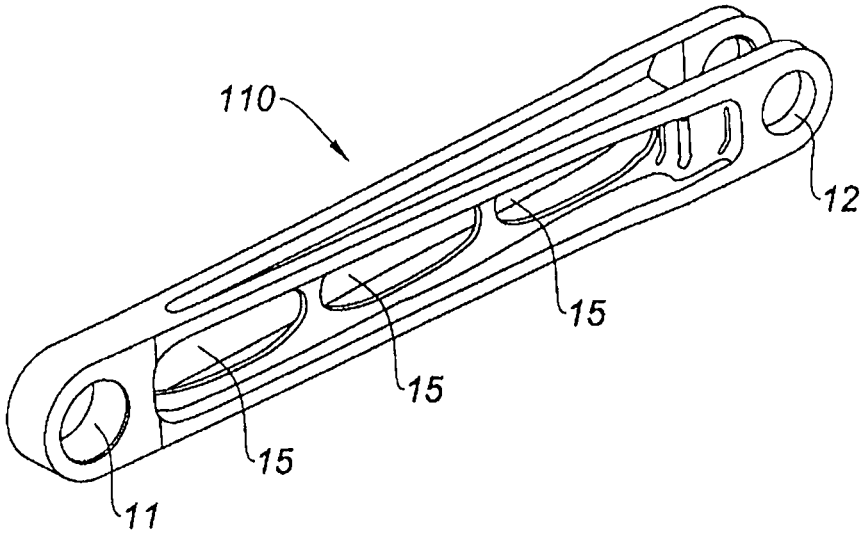
FIG. 10 is a perspective view of the example of a mechanical component obtained according to the alternative form of the method of manufacture of the invention.

According to an alternative form of the invention, the mechanical component may be of more complex shape and comprise a plurality of inserts 3, each insert 3 comprising filaments 32 directed in a rectilinear direction. In the example depicted in FIG. 8, the method of manufacture is modified by using a second container 104 which comprises, on each side of two of its opposing faces 42, grooves 41 intended to accommodate inserts 3. Following hot isostatic compaction and machining, the mechanical component 110 obtained is that depicted in FIG. 9 and thus comprises inserts 3. The inserts 3 are positioned on each side of a mid-plane P1 of the mechanical component 110. They are positioned in planes P2 and P3 that are at a non-zero angle $\alpha$ to one another. FIG. 10 is a perspective view of a mechanical component 110 thus obtained. This mechanical component 110 may equally have recesses 15 intended to reduce the weight thereof.

Figure 12:
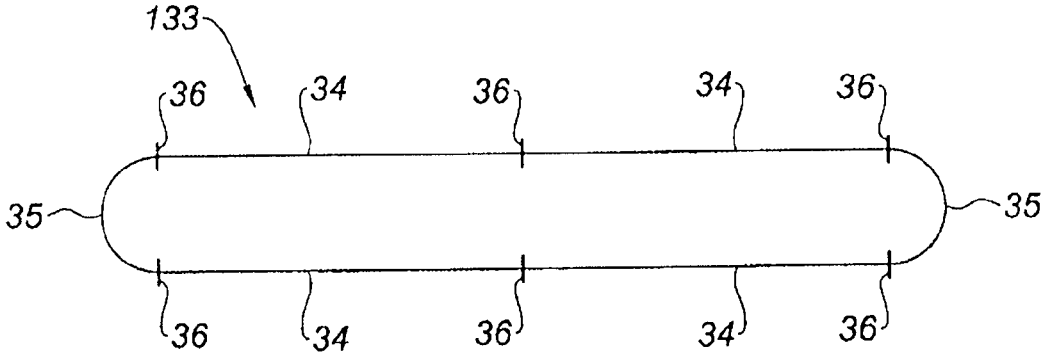
FIG. 12 is a schematic view of an insert preform according to a second embodiment of the invention.

According to a second embodiment of the invention, depicted in FIG. 12, a cylindrical component 2, comprising rectilinear winding portions 24 longer than those of the first embodiment, is used. Thus, it is possible to extract and manufacture a greater number of inserts 3. To do this, the preform 133 is cut, extracting several inserts 3 from one and the same rectilinear portion 34 of the preform 133.

Figure 11:
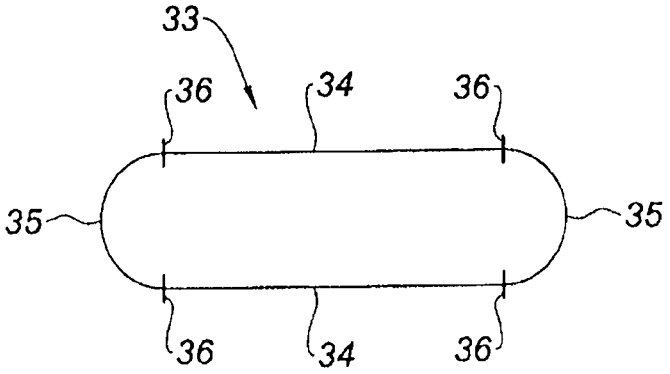
FIG. 11 is a schematic view of an insert preform according to a first embodiment of the invention.

FIG. 11 corresponds to the first embodiment of the invention.

Figure 13:
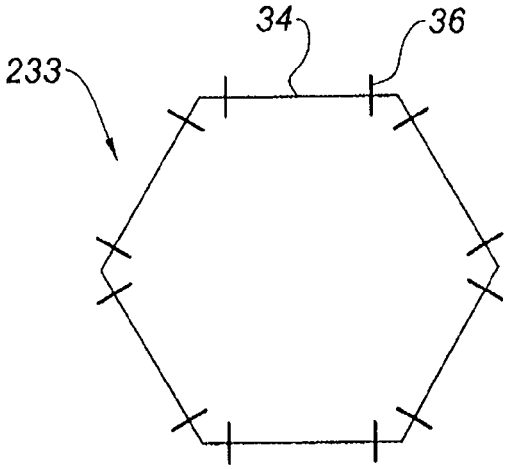
FIG. 13 is a schematic view of an insert preform according to a third embodiment of the invention.

According to the third embodiment of the invention, a great many inserts 3 can be obtained by using a cylindrical component 233 of polygonal shape, that is to say a cylindrical component 220 comprising a plurality of rectilinear winding portions 224. FIG. 13 depicts one example of an insert 3 preform 233 obtained according to this third embodiment. The preform 233 of polygonal shape, depicted by way of example, is a hexagon comprising six rectilinear portions 34 and twelve cutting planes 36. It is possible to obtain a number of inserts other than six by using a polygon having more than or less than six sides.

Figure 14:
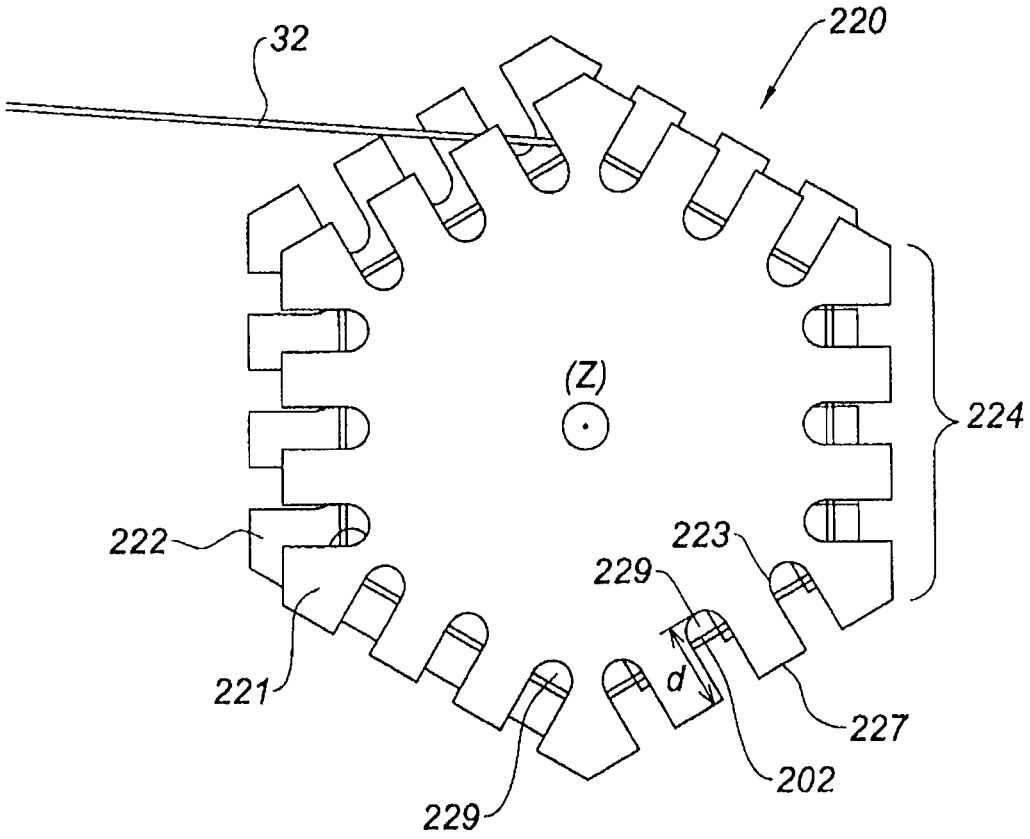
FIG. 14 is a perspective view of one example of a winding device according to a third embodiment of the invention.

To obtain such a preform, it is necessary to use a winding device 220 comprising a cylindrical component 202 of polygonal shape, it being possible for this cylindrical component 202, preferably, to be sandwiched between two polygonal end plates 221 and 222. The winding device 220 of the third embodiment according to the invention, depicted in FIG. 14, has features in common with the winding device 20 of the first embodiment of the invention because is has slots 223 on its periphery 227 and because the inside 229 of the polygonal cylindrical component 202 is hollow, its operation being identical.

Such mechanical components 10 or 110 are perfectly suited to aeronautical applications, for example to undercarriages or to the turbomachines intended for an aircraft.

Figure 15:
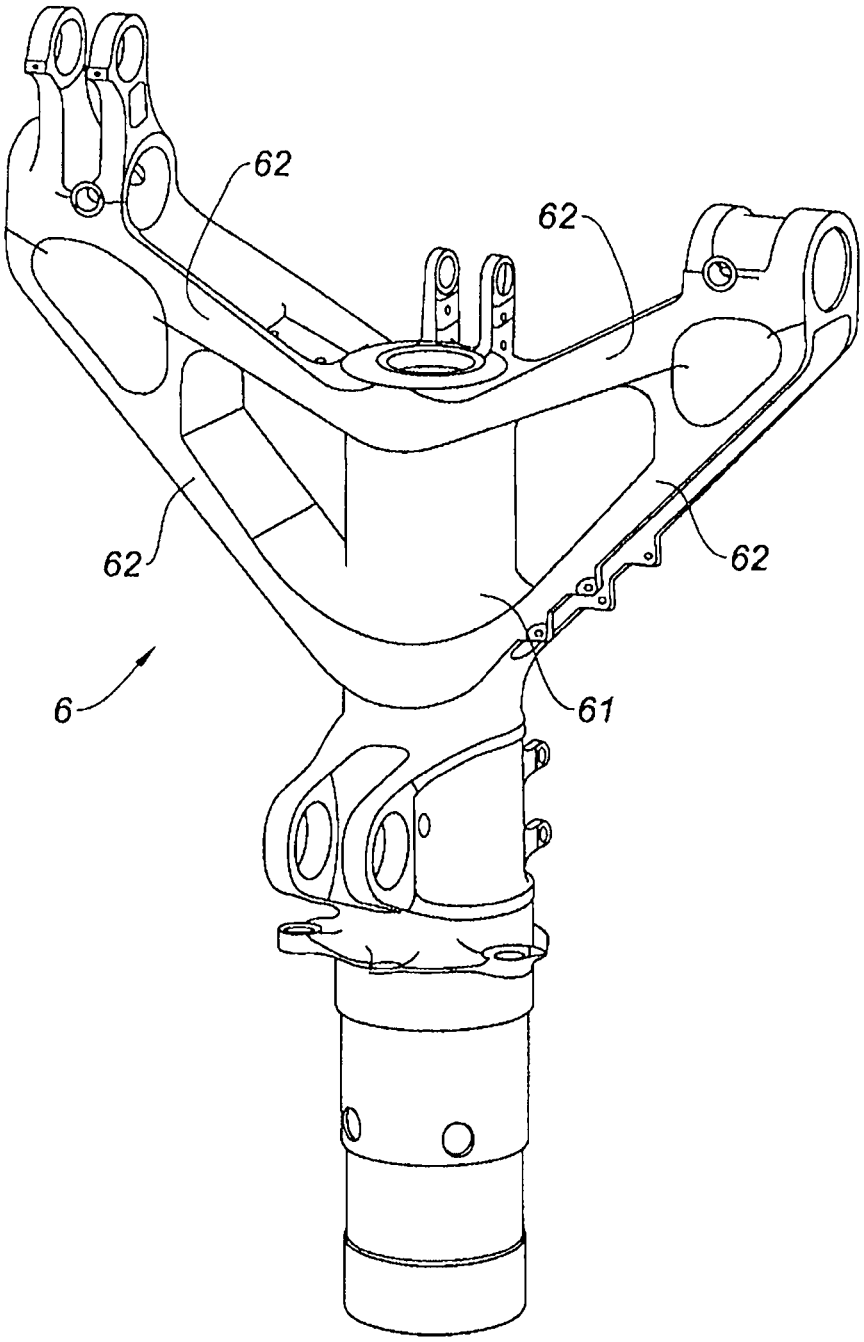
FIG. 15 is a perspective view of an undercarriage comprising a mechanical component according to the invention.

An example of an undercarriage 6 is depicted in FIG. 15. An undercarriage 6 comprises a box 61, constituting the major structural component, and arms 62. The arms are intended to transmit a tensile and/or compressive force mainly in one direction. The arms 62 may therefore constitute mechanical components according to the invention without actually forming rods 110. In this case, the inserts 3 are contained in the arms 62.

The invention claimed is:

1. A method of manufacturing a mechanical component including at least one insert made of metal matrix composite, within which matrix ceramic fibers extend, the composite insert being obtained from a plurality of coated filaments having a longitudinal axis, each coated filament including a ceramic fiber coated with a metal sheath, the method comprising:

manufacturing an insert preform by winding a bonded lap or bundle of coated filaments about a cylindrical component, wherein the insert perform includes a portion which extends in a rectilinear direction parallel to the longitudinal axis of the coated filaments and a portion which is curved;

inserting the insert preform in a first container;

performing hot isostatic compaction of the first container; and machining the first container to remove the curved portion of the insert preform and a corresponding portion of the first container so as to form a rectilinear insert extending rectilinearly between a first end and a second end, wherein the coated filaments corresponding to the portion of the insert preform extending in the rectilinear direction are provided in the rectilinear insert such that all of the coated filaments in the rectilinear insert extend in the rectilinear direction.

2. The method of manufacturing a mechanical component as claimed in claim 1, further comprising:

inserting the insert in a second container;

performing hot isostatic compaction of the second container; and machining the second container to form a mechanical component.

3. The method of manufacturing a mechanical component as claimed in claim 2, wherein the cylindrical component comprises at least one rectilinear winding portion.

4. The method of manufacturing a mechanical component as claimed in claim 3, wherein the cylindrical component includes two rectilinear winding portions, the two rectilinear portions being fitted in between two circular portions.

5. The method of manufacturing a mechanical component as claimed in claim 4, wherein the two circular portions have different radii.

6. The method of manufacturing a mechanical component as claimed in claim 3, wherein the winding is performed around the cylindrical component, of polygonal shape.

7. The method of manufacturing a mechanical component as claimed in claim 3, further comprising maintaining a shape of the insert preform prior to inserting the insert preform in the first container.

8. The method of manufacturing a mechanical component as claimed in claim 7, wherein the maintaining the shape includes fitting metal bands around the insert preform.

9. The method of manufacturing a mechanical component as claimed in claim 7, wherein the maintaining the shape includes winding a metal foil around the insert preform.

10. The method of manufacturing a mechanical component as claimed in claim 7, wherein the maintaining the shape includes welding the coated filaments together.

11. The method of manufacturing a mechanical component as claimed in claim 1, wherein the insert preform includes first and second portions which extend in the rectilinear direction, and the curved portion is disposed between the first and second rectilinear portions.

12. The method of manufacturing a mechanical component as claimed in claim 1, wherein the first container includes a groove into which the insert preform is inserted, the groove including a rectilinear section and a curved section corresponding to the rectilinear portion and the curved portion of the insert preform.

* * * * *